US006988287B1

(12) United States Patent
Swartzburg

(10) Patent No.: US 6,988,287 B1
(45) Date of Patent: Jan. 24, 2006

(54) TOPPER FOR A BED AND METHOD OF USE

(76) Inventor: Rick T. Swartzburg, 1472 Valecroft Ave., Westlake Village, CA (US) 91361

( * ) Notice: Subject to any disclaimer, the term of this patent is extended or adjusted under 35 U.S.C. 154(b) by 0 days.

(21) Appl. No.: 10/743,648

(22) Filed: Dec. 22, 2003

(51) Int. Cl.
*A47C 27/14* (2006.01)

(52) U.S. Cl. ..... 5/691; 5/903; 5/727; 5/740

(58) Field of Classification Search ..... 5/691, 5/903, 722, 727, 740
See application file for complete search history.

(56) References Cited

U.S. PATENT DOCUMENTS 4,336,621 A * 6/1982 Schwartz et al. ..... 5/658
RE32,734 E * 8/1988 McLeod ..... 5/722
4,955,095 A * 9/1990 Gerrick ..... 5/691
6,101,653 A * 8/2000 England ..... 5/738
6,159,574 A * 12/2000 Landvik et al. ..... 428/71
6,602,579 B2 * 8/2003 Landvik ..... 428/158
6,715,173 B2 * 4/2004 Barman et al. ..... 5/691

* cited by examiner

*Primary Examiner*—Michael Trettel

(74) *Attorney, Agent, or Firm*—Ted Masters

(57) ABSTRACT

A topper for selectively changing the firmness of a bed includes first and second sheets of foam which are bonded together at a flexible interface. The firmness of the first and second sheets differ, so that by putting one sheet face up on the bed one level of firmness is achieved, and by reversing the topper and putting the other sheet face up another level of firmness is achieved.

3 Claims, 3 Drawing Sheets

Fig. 1
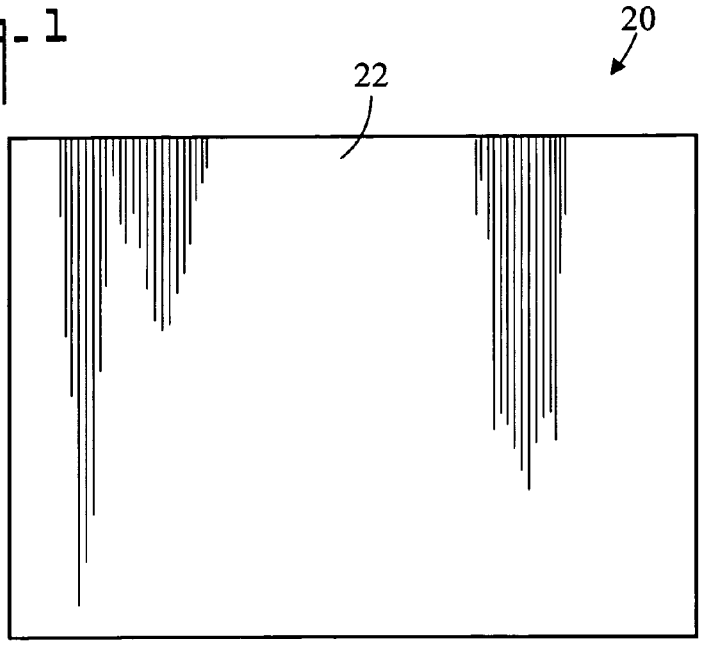
Fig. 3
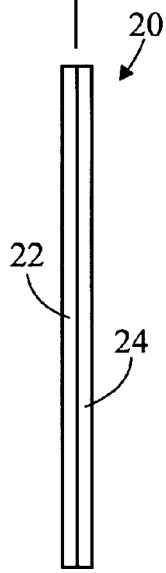
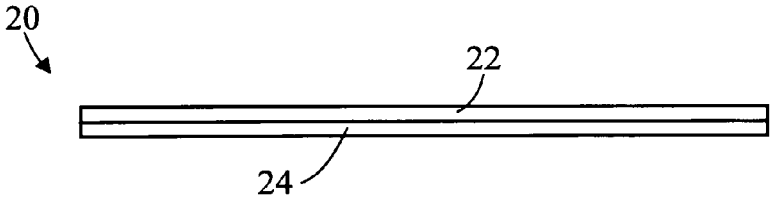
Fig. 2
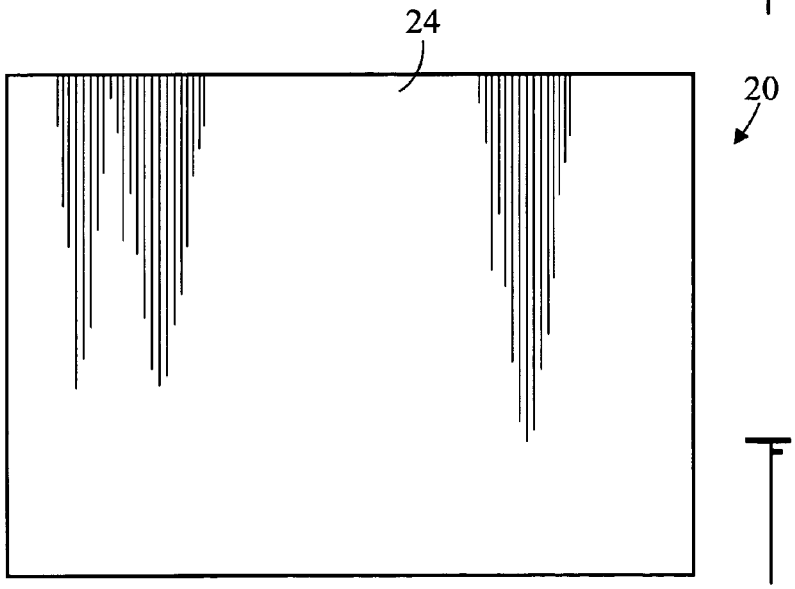
Fig. 4

TOPPER FOR A BED AND METHOD OF USE

TECHNICAL FIELD

The present invention pertains generally to beds, and more particularly to a topper which is placed on top of a bed to change the firmness of the bed in accordance with the preference of a user.

BACKGROUND OF THE INVENTION

With the high cost of mattresses, more and more people were attempting to find a good foam mattress topper to add comfort to their existing mattress and thereby obviate the need for a new mattress. The thickness of the topper is usually between one and four inches. Over four inches would be too high to fit an existing bed, and less than one inch would not be provide enough material to provide the needed comfort needed. Toppers are typically fabricated from several variations of latex, polyurethane, and memory foams of differing indentation load deflection (ILD) and weight.

Patent Application U.S. 2003/0097715 illustrates a selectively contoured single unibody foam piece for use as a layer in a cushioned load bearing structure has a first zone with a first surface topography having distinct support properties from a second zone with a second surface topography. The zones of differing topography are formed in the surface of a single, unibody piece of foam by applicable foam cutting techniques. Patterned removal of foam material from a single piece creates zones with different density, ILD or other load bearing properties with different support and feel characteristics. A single unibody component in a responsive flexible support structure has distinct zones with distinct support characteristics, the zones corresponding in location with the anticipated loads and loading patterns of a flexible support device in use.

U.S. Pat. Re. 32,734 discloses a cushion or mattress assembly having first and second resilient support surfaces of varying firmness each secured to a center piece stiffener board. The stiffener board is formed from a plurality of hinged sections allowing flexure of the stiffener board in one direction only, as well as allowing the entire assembly to be folded or rolled up for storage.

BRIEF SUMMARY OF THE INVENTION

The present invention is directed to a topper for a bed. A topper is also commonly called a foam overlay, a foam topper, and a foam mattress. The topper consists of two sheets of foam which are bonded together. The firmness of the sheets is different, so that one sheet is firmer than the other sheet. The topper is placed on top of a mattress to make the mattress more comfortable, and are reversible to provide more firmness or softness as desired without having to buy a new mattress or change to a different mattress topper. The present invention provides users with a way to make their mattress feel more comfortable with a mattress topper which has either (1) a layered feel of softness over a more supportive firm layer, or (2) a layered feel of firmness over a less supportive soft layer. This allows the user to choose a different feel if there preferences change or if another person sleeps on their mattress and has a different firmness preference.

However, for a mattress topper to be reversible and still have the comfort of using both layers for support, a bonding process must be used that will still allow the user to feel through both layers to the mattress below. This gives the user the benefit of the mattress below for support, with comfort of the two layered design of the topper. It also retains the ability to be reversible in feel, as the user can choose which level of softness he or she desires directly placed under their body. To retain this flexibility, but still maintain a one piece design, a very soft and flexible glue or heating process is needed to bond the two layer topper together.

While one layer toppers that are made out of various densities of foam were created to add comfort to an existing mattress and to allow for different softness preferences, a two layer topper with reversibility enhances comfort by going from a softer (lower ILD) and/or different density on one side, to a more firm higher ILD or densitiy on the opposite side. In a preferred embodiment of the present invention one memory foam layer that is a 10 ILD 4 lb., that is placed over a 20 ILD 5 lb. density memory foam layer. This gives a feeling of immediate softness, or a little more firmness, but either way allows the user to get cushioning over the existing mattress without loosing the support of their overall mattress. The mattress topper must be at least one inch thick and no more than four inches thick, as any less would not be enough to change the mattress feel below, and any more would be too much material and change the efficiency of the mattress support below the topper. Also, another advantage to using no more than four inches is the ease of portability from one mattress to another for purposes of travel. This is also made easier because it is made of pure foam, so it can be compressed to a very small size for traveling.

In accordance with a preferred embodiment of the invention, a topper for a bed comprises:

- a first sheet of foam, the first sheet having a first firmness;
- a second sheet of foam, the second sheet having a second firmness different from the first firmness;
- the first sheet and the second sheet bonded together in stacked aligned relationship; and,
- so that the topper may be (1) placed on top of the bed with the first sheet facing upward to present a first firmness to a user, or (2) placed on top of the bed with the second sheet facing upward to present a second firmness to a user.

In accordance with an aspect of the invention:

- the first sheet fabricated from 10 ILD 4 lb memory foam; and,
- the second sheet fabricated from 20 ILD 5 lb memory foam.

In accordance with another aspect of the invention:

- the first sheet and the second sheet are bonded together so that a flexible interface is created between the first sheet and the second sheet.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 1 is a top plan view of a topper for a bed in accordance with the present invention;

FIG. 2 is a side elevation view of the topper;

FIG. 3 is an end elevation view of the topper;

FIG. 4 is a bottom plan view of the topper;

DETAILED DESCRIPTION OF THE INVENTION

Referring initially to FIGS. 1–5, there are illustrated top plan, side elevation, end elevation, bottom plan, and perspective views respectively of a topper for a bed in accordance with the present invention, generally designated as 20. Topper 20 comprises a separate overlay which is typically placed on top of the mattress of a bed (refer to FIGS. 7 and 8).

Figure 7:
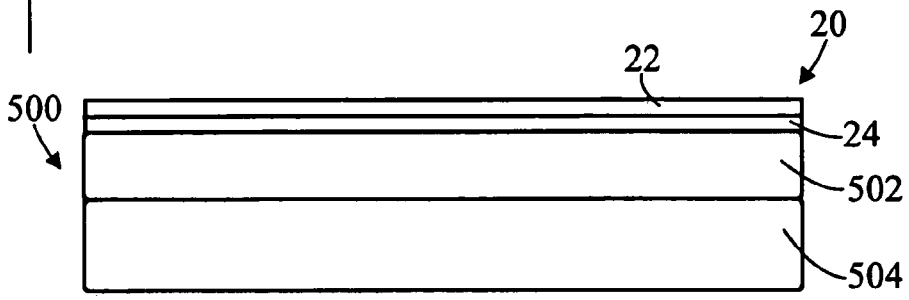
FIG. 7 is a side elevation view of the topper placed upon a bed with a first sheet facing upward.
Figure 8:
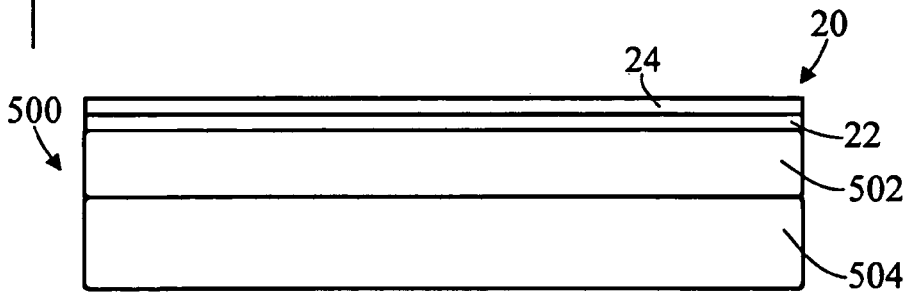
FIG. 8 is a side elevation view of the topper placed upon a bed with the second sheet facing upward; and, FIG. 9 is an enlarged fragmented cross sectional view of a load being applied to the topper.

Topper 20 includes a first sheet 22 of foam having a first firmness, and a second sheet 24 of foam having a second firmness different from the first firmness. That is, one side of topper 20 is firmer than the other side. First sheet 22 and second sheet 24 are bonded together in stacked aligned relationship. As used herein stacked aligned relationship means that one sheet is placed on top of the other sheet with the edges of the sheets aligned (as one would stack two sheets of plywood). Bonded together means that the two sheets are directly connected so that they effectively act as one thicker sheet. The bonding may be effected by a flexible adhesive or by a heating process. It is important that a ridged layer not exist between the two sheets, but rather that the interface (joint) between the sheets is flexible. Referring also to FIGS. 7 and 8, topper 20 may be (1) placed on top of the bed with the first sheet facing upward to present a first firmness to a user (FIG. 7), or (2) placed on top of the bed with the second sheet facing upward to present a second firmness to a user (FIG. 8). In a preferred embodiment of the invention, first sheet 22 is fabricated from 10 ILD 4 lb memory foam, and second sheet 24 is fabricated from 20 ILD 5 lb memory foam. This combination has been found particularly useful in that first sheet 22 provides a soft feel which rapidly conforms to a user's body, while second sheet 24 provides a firm feel which more slowly conforms to a user's body. Additionally the memory foam results in a softer feel in that once the foam is deformed, it tends to maintain the deformed state and does not "push back" at the user.

In a preferred embodiment of the invention, the thickness of topper 20 is between one inch and four inches. Also in the shown embodiment, first sheet 22 and second sheet 24 are of substantially equal in thickness. However embodiments having unequal thicknesses are also possible (for example 75% thickness first sheet 22, and 25% thickness second sheet 24).

Figure 5:
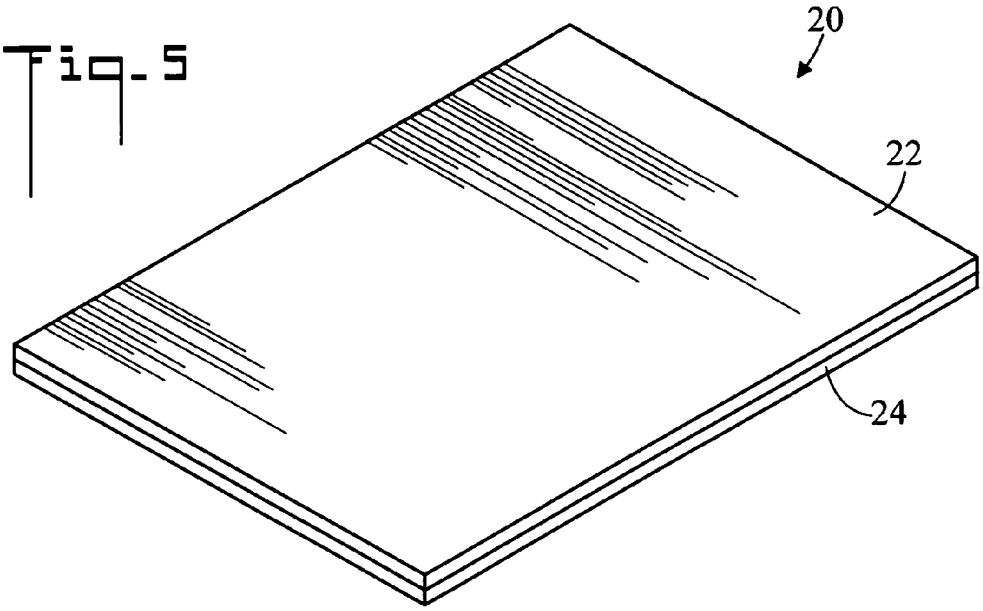
FIG. 5 is a perspective view of the topper.
Figure 6:
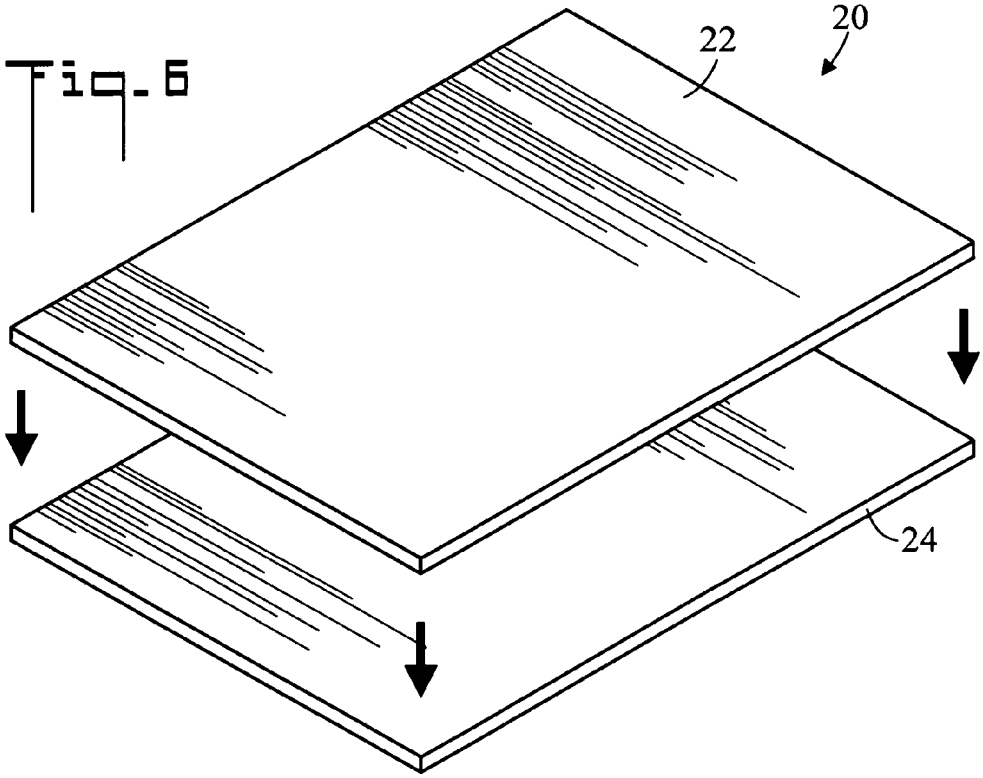
FIG. 6 is an exploded perspective view showing the two foam sheets that form the topper.

FIG. 6 is an exploded perspective view showing the two foam sheets that form topper 20. First sheet 22 is aligned with second sheet 24 and then the two sheet are bonded together.

FIG. 7 is a side elevation view of topper 20 placed upon a bed 500 with a first sheet 22 facing upward. In the shown embodiment, bed 500 comprises a conventional mattress 502 and box spring 504. However, it may be appreciated that topper 20 could also be utilized on other bed configurations, such as just mattress 502, just box spring 504, or even a hard surface such as a floor or the ground.

FIG. 8 is a side elevation view of topper 20 placed upon bed 500 with second sheet 24 facing upward.

Figure 9:
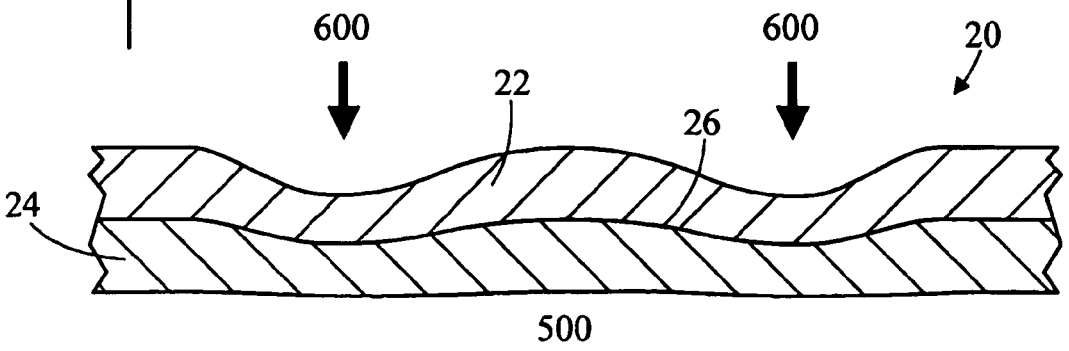

FIG. 9 is an enlarged fragmented cross sectional view of a load being applied to topper 20. First sheet 22 and second sheet 24 are bonded together so that a flexible interface 26 is created between first sheet 22 and second sheet 24. Topper 20 is placed on top of bed 500 with first sheet 22 facing upward. When a downward load 600 (such as from the body of a user) is applied to first sheet 22, both first sheet 22 and second sheet 24 locally compress (only compress in the immediate vicinity of the load) in response to the applied load 600. Similarly, when topper 20 is reversed, both second sheet 24 and first sheet 22 will similarly locally compress when load 600 is applied.

In terms of use, a method for changing the firmness of a bed, comprises:

(a) providing a bed 500;

(b) providing a topper 20 for bed 500, topper 20 including:

a first sheet 22 of foam, first sheet 22 having a first firmness;

a second sheet 24 of foam, second sheet 24 having a second firmness different from the first firmness;

first sheet 22 and second sheet 24 bonded together in stacked aligned relationship;

(c) a user selecting one of the first firmness and the second firmness; and, (d) the user placing topper 20 on top of bed 500 so that the sheet corresponding to the selected firmness faces upward.

The method further including:

(e) a second user selecting the other of the first firmness and the second firmness; and, (f) the second user placing topper 20 of top of bed 500 so that the sheet corresponding to the selected firmness faces upward.

The method further including:

in (b), first sheet 22 fabricated from 10 ILD 4 lb memory foam; and, in (b), second sheet 24 fabricated from 20 ILD 5 lb memory foam.

The method further including:

in (d), the user placing topper 20 on top of bed 500 with first sheet 22 facing upward; and, the user applying a downward load to first sheet 22 wherein both first sheet 22 and second sheet 24 compress in response to the applied load.

The method further including:

in (d), the user placing topper 20 on top of bed 500 with second sheet 24 facing upward; and, the user applying a downward load to second sheet 24 wherein both second sheet 24 and first sheet 22 compress in response to the applied load.

The method further including:

the first firmness being less firm than the second firmness;

wherein when topper 20 is placed on top of bed 500 so that first sheet 22 faces upward, topper 20 provides a feeling to a user of softness over a supportive lower layer; and, when topper 20 is placed on top of bed 500 so that second sheet 24 faces upward, topper 20 provides a feeling to a user of firmness over a yielding lower layer.

Another useful feature of topper 20 is the convenience in which it may be transported. This feature is beneficial to a user who must sleep in a foreign bed 500 (such as at a motel). Since topper 20 can be easily rolled up and transported, the user can take topper 20 to the foreign bed 500, and thereby provide a desired bed firmness. In terms of use, a method for providing a desired bed firmness to a user who must sleep in a foreign bed 500 comprises:

(a) providing a foreign bed 500;

(b) providing a topper 20 for bed 500, topper 20 including:

a first sheet 22 of foam, first sheet 22 having a first firmness;

a second sheet 24 of foam, second sheet 24 having a second firmness different from the first firmness;

first sheet 22 and second sheet 24 bonded together in stacked aligned relationship;

(c) a user transporting topper to foreign bed 500;

(d) the user selecting one of the first firmness and the second firmness; and, (d) the user placing topper 20 on top of bed 500 so that the sheet corresponding to the selected firmness faces upward.

The preferred embodiments of the invention described herein are exemplary and numerous modifications, variations, and rearrangements can be readily envisioned to achieve an equivalent result, all of which are intended to be embraced within the scope of the appended claims.

What is claimed is:

1. A method for a user to change the firmness of a bed, comprising:

(a) providing a bed;

(b) providing a topper for said bed, said topper including:

a first sheet of foam, said first sheet having a first firmness;

a second sheet of foam, said second sheet having a second firmness different from said first firmness;

said first sheet and said second sheet bonded together in stacked aligned relationship;

(c) for the purpose of obtaining a preferred firmness, the user selecting one of said first firmness and said second firmness;

(d) the user placing said topper on top of said bed so that said sheet corresponding to said selected firmness faces upward; and, in (b), said first sheet and said second sheet being of equal thickness.

2. A topper for a bed, comprising:

a first sheet of foam, said first sheet having a first firmness;

a second sheet of foam, said second sheet having a second firmness different from said first firmness;

said first sheet and said second sheet bonded together in stacked aligned relationship;

so that said topper may be (1) placed on top of the bed with said first sheet facing upward to present a first firmness to a user, or (2) placed on top of the bed with said second sheet facing upward to present a second firmness to a user; and, said first sheet and said second sheet being of equal thickness.

3. The topper of claim 2, further including:

said first sheet fabricated from 10 ILD 4 lb memory foam; and, said second sheet fabricated from 20 ILD 5 lb memory foam.

* * * * *